US012163256B2

(12) United States Patent
Gürtler et al.

(10) Patent No.: US 12,163,256 B2
(45) Date of Patent: Dec. 10, 2024

(54) LYOCELL FIBER TOW, ITS MANUFACTURE AND USE

(71) Applicant: LENZING AKTIENGESELLSCHAFT, Lenzing (AT)

(72) Inventors: Andreas Gürtler, Weyregg (AT); Robert David Jeavons, Market Rasen (GB); Paul Lawrence Probert, Goulceby (GB)

(73) Assignee: LENZING AKTIENGESELLSCHAFT, Lenzing (AT)

( * ) Notice: Subject to any disclaimer, the term of this patent is extended or adjusted under 35 U.S.C. 154(b) by 475 days.

(21) Appl. No.: 17/602,329

(22) PCT Filed: Mar. 20, 2020

(86) PCT No.: PCT/EP2020/057844
§ 371 (c)(1),
(2) Date: Oct. 8, 2021

(87) PCT Pub. No.: WO2020/207767
PCT Pub. Date: Oct. 15, 2020

(65) Prior Publication Data

US 2022/0195628 A1 Jun. 23, 2022

(30) Foreign Application Priority Data

Apr. 10, 2019 (EP) ..... 19168404

(51) Int. Cl.
*D01D 5/22* (2006.01)
*D01F 2/00* (2006.01)
*D02G 1/12* (2006.01)
*D02G 3/04* (2006.01)

(52) U.S. Cl.
CPC ..... *D01D 5/22* (2013.01); *D01F 2/00* (2013.01); *D02G 1/12* (2013.01); *D02G 3/045* (2013.01); *D10B 2201/22* (2013.01)

(58) Field of Classification Search
None
See application file for complete search history.

(56) References Cited

U.S. PATENT DOCUMENTS

| | | | |
|---|---|---|---|
| 3,664,115 | A | 5/1972 | Watson |
| 4,246,221 | A | 1/1981 | McCorsley, III |
| 4,416,698 | A | 11/1983 | McCorsley, III |
| 7,270,779 | B2 | 9/2007 | Zikeli et al. |
| 2004/0051202 | A1 | 3/2004 | Zikeli et al. |

(Continued)

FOREIGN PATENT DOCUMENTS

| | | | |
|---|---|---|---|
| CN | 1469943 | A | 1/2004 |
| CN | 102704073 | A | 10/2012 |

(Continued)

OTHER PUBLICATIONS

"Terminology of Man-Made Fibers," BISFA (The International Bureau for the Standardization of Man-Made Fibers), 2009 Edition (2009).

*Primary Examiner* — Shawn Mckinnon
(74) *Attorney, Agent, or Firm* — Venable LLP

(57) ABSTRACT

This invention relates to a crimped lyocell tow for use in stretch breaking, worsted or semi worsted spinning, its manufacture and use.

13 Claims, 2 Drawing Sheets

(56) References Cited

U.S. PATENT DOCUMENTS

| | | | | |
|---|---|---|---|---|
| 2013/0122770 | A1* | 5/2013 | Wahal | D02G 1/16 428/374 |
| 2017/0292207 | A1 | 10/2017 | Kim et al. | |

FOREIGN PATENT DOCUMENTS

| | | | |
|---|---|---|---|
| CN | 106757906 | A | 5/2017 |
| CN | 107075739 | A | 8/2017 |
| EP | 1 327 013 | B1 | 1/2007 |
| EP | 1 307 610 | B2 | 1/2011 |
| GB | 1325259 | A | 8/1973 |
| JP | 2004044008 | A | 2/2004 |
| JP | 2007119939 | A | 5/2007 |
| KR | 101189982 | B1 | 10/2012 |
| WO | 2016/025967 | A1 | 2/2016 |
| WO | WO2018222872 | * | 12/2018 |

* cited by examiner

LYOCELL FIBER TOW, ITS MANUFACTURE AND USE

The present application is a national-stage entry under 35 U.S.C. § 371 of International Patent Application No. PCT/EP2020/057844, published as WO 2020/207767 A1, filed Mar. 20, 2020, which claims priority to EP 19168404.2, filed Apr. 10, 2019, the entire disclosure of each of which is hereby incorporated by reference.

BACKGROUND OF THE INVENTION

Field of the Invention

This invention relates to a crimped lyocell tow for use in stretch breaking, worsted or semi worsted spinning, its manufacture and use.

Description of Related Art

Man-made cellulosic fibers of the viscose type and modal type are produced according to the viscose process. In recent years the "amine-oxide-process" or "lyocell process" has been established as alternative to the viscose process, wherein cellulose, without forming a derivative, is dissolved in an organic solvent of an amine-oxide, in particular N-methylmorpholine-N-oxide (NMMO).

In said process, the solution of cellulose is usually extruded by means of a forming tool, whereby it is molded via an air gap; the molded solution gets into a precipitation bath, where the molded body is obtained by precipitating the solution. The molded body is washed and dried, optionally after further treatment steps.

Cellulosic fibers produced from such solutions are called "solvent-spun" fibers and have received by BISFA (The International Bureau for the Standardization of man-made Fibers) the generic name lyocell. A process for the production of lyocell fibers is described, for instance, in U.S. Pat. No. 4,246,221. The amine oxide process yields fibers which are distinguished by a high tensile strength, a high wet-modulus and a high loop strength.

Man-made cellulosic fibers, such as viscose, modal, lyocell and others, are mainly used in cotton-like applications, i.e. in the form of staple fibers with a discrete staple length of about 32 to 60 mm. They are applied either pure or in blends with cotton, other man-made cellulosic fibers or synthetic fibers of comparable staple length. However, there are also applications which require longer staple lengths, such as blends with wool, acrylic, nylon or other long staple fibers for worsted spinning. For example, very fine yarns can be made thereby. Such applications require special technologies like worsted yarn spinning and also require fibers with very specific processing performance which cannot be provided by the regular cotton-type fibers.

The usual way to provide man-made cellulosic fibers for such applications is to cut them into longer staple length (i.e. longer than 60 mm) during fiber production and to make the yarns using worsted carding, gilling, combing, rubbing or roving and spinning process steps. However, carding of man-made cellulosic fibers with fine fiber titer and longer staple length gives increased number of neps which is not acceptable in this high-price market segment. It is for this reason that most long staple or Bias Cut products for worsted carding and combing are not produced at less than 1.7, 2.0 or even 2.4 dtex fiber titer.

Another way to make worsted yarn out of man-made fibers is by stretch breaking. The principle of stretch breaking is as follows: The tow is gradually stretched to the point of breaking (a tow comprises of a bundle of essentially parallel filaments which are not handled individually). The fiber is mainly broken in the final two breaking zones of common stretch breaking machines. It is important to avoid high drafts in the earlier zones to avoid early breaking of the tow (pre-breaking). The product resulting from the breaking process is the so-called "top". There is a crimper at the end of the machine for mechanical crimping of the top—to hold it together for the gilling processes. The tops can be blended at the gill box with wool, acrylic, nylon or other long staple fibers for worsted spinning.

However up to now there was no suitable lyocell filament known which could be used for stretch breaking processing.

Problem

In view of this prior art the problem to be solved consisted in providing lyocell tows suitable for making fine worsted or semi worsted yarns, either pure or in blend with other fine fibers, as well as a method for producing such tows in a commercial scale.

DESCRIPTION

It is therefore an object of the present invention to provide a lyocell tow for use in stretch breaking, worsted or semi worsted spinning, wherein the individual filaments are crimped and have a filament titer in the range of between 0.8 and 1.4 dtex and that the tow has a tow titer of between 60 and 160 ktex and a length of between 1,000 and 10,000 m. A tow length of between 1,500 and 5,000 m may be preferred in most cases.

Worsted spinning allows production of yarns with different aesthetics in terms of handle, touch, drape and overall appearance compared to short staple or cotton system spun textile products. Normally much lower twist factors are used for such yarns because of the much higher mean fiber length used for worsted spinning. This allows very soft and luxurious products much appreciated by downstream customers. With lyocell finer yarn counts than with viscose are possible due to higher tenacity; the worsted spinning of fine dtex fiber in the range specified is only possible using the stretch break conversion technology, because long fibers in finer dtex ranges would result in many neps if processed by the worsted carding and combed process route. Only production of fine and micro lyocell tows would allow such products in lyocell and lyocell blends to be produced in the future ("micro" means a fiber titer of less than 1.0 denier, i.e. less than 1.1 dtex). Production of such fine and micro lyocell tows in the future would allow production of even finer, higher quality worsted spun yarn counts for 100% lyocell and for lyocell blends with other fibers.

In a preferred embodiment of this invention the lyocell tow according to the invention is crimped, though uncrimped tow can also be used for stretch breaking in principle. Up to now no crimped tow of man-made cellulosic fibers was existing.

For an arrangement according to the invention as described above, one skilled in the art would expect that even after splitting the tow by means of the primary and secondary guides some filaments of sub tows will tend to attach to adjacent sub tows. Such attachment would make a proper plaiting into and taking out of the same container of several separated sub tows impossible. Indeed this may happen with uncrimped sub tows. But surprisingly it was found that by applying crimp in the manner according to the invention proper plaiting into and taking out of the same container of several separated sub tows works without any problems.

In a further preferred embodiment of this invention the lyocell tow according to the invention is supplied with a finish suitable for stretch break and onward worsted and semi worsted processing. In particular in the embodiment called "single split" as described further below a finish type suitable for both short staple and worsted spinning fiber may be applied to the lyocell line at the same time, because separate finish baths for both product types create more cost and may be not feasible.

In a particularly preferred embodiment of this invention the fibers in the lyocell tow according to the invention have a crosslinked surface. Crosslinking can be done by generally known technologies, using e.g. crosslinking agents with triazine structure, even more specifically using TAHT or NHDT as crosslinking compounds. Other suitable molecules are applicable, as well. TAHT is a preferred crosslinking agent if the fibers are intended to be used in blends with wool.

The invention incorporates an established method of making of solvent-spun cellulose according to the lyocell process in which:

i. cellulose is dissolved in an amine oxide solvent to form a hot cellulose solution,
ii. the hot cellulose solution is extruded through a die assembly to form a full tow band of continuous filaments,
iii. the tow is passed through a water bath to leach out the amine oxide,
iv. the tows originating from several die assemblies are collected in a filament collection zone,
v. the tow is treated to meet various process applications,
vi. the tow is dried, (the tow may have a full tow band titer of about 400 to 1100 ktex, mostly determined by the washing and/or drying capacity)
vii. the tow is split once or multiple times as well as crimped according to the invention (as dictated by the processing end use), the crimped or uncrimped tows are transported from the crimper to the next step, i.e. plaiting into a suitable container or respectively cut to short staple fibers.

It is another object of the present invention to provide a method for the manufacture of lyocell tow useable in stretch breaking, worsted and semi worsted spinning, which consists in that a coagulated, washed and dried lyocell full tow band is:

a. split into (m+1) primary sub tows by m primary guides,
b. all primary sub tows are jointly passed through a crimper where they optionally can be jointly compressed to apply crimp,
c. at least m primary sub tows are cut to lengths of between 1,000 and 10,000 m, preferably of between 1,500 and 5,000 m, and subsequently plaited into containers The crimper may be a gear crimper or a stuffer box crimper, both of which are generally known in the art as well as how to operate them. A stuffer box crimper is generally preferred. Dry steam will be injected into the stuffer box during the crimping process.

Nip roller pressure, stuffer box pressure and dry steam injected flow rate in the stuffer box are regulated within defined parameters contingent with fiber process specifications, wherein the tow then exhibits a fix memory of the introduced split.

Material exiting the crimper is then comprised of simultaneous, parallel production of two crimped tows. The tow has an inherent retention of the split introduced prior to the crimper and therefore it is easy to separate again the final sub tows when taking them out of the container for further processing. Containers could be cans or cartons or the like; common containers have a capacity of about 300 kg, but they may have a smaller or higher capacity, as well.

Regular requirements for manufacturing commercially suitable stretch broken fibers are, among others, a uniform and parallelized tow with minimal broken ends or deformations, minimal knots in the tow—to be clearly identified (max 1 per bale) and excellent plaiting of tow for baling with no twisting of the tow. Further needed are extremely low levels of trash (dust, short fiber), i.e. at around 20-30% of any normal staple specification tolerance. These requirements can be fulfilled by the invention.

A first preferred embodiment of the inventive method, the so-called "single-split" embodiment, comprises the following features:

m is 1,
the first sub-tow is plaited into a container and
the second sub-tow is further cut into staple fibers with controlled equal length of between 20 and 60 mm.

A further unique and novel feature of this embodiment of the invention is that during single split collection the simultaneous, parallel production of two crimped tows for completely different yarn processing routes can be undertaken at the same time.

The single sub-tow at the required tow titer for stretch-breaking can then be separated and split off from the main tow and collected in containers. The remaining residual second sub-tow at the same time is then cut to staple lengths suitable for conventional carding process and any other number of different yarn processing routes to meet various textile end uses. Staple length of between 20 and 60 mm are most common for textile applications.

Preferably in this embodiment according to the invention the first sub-tow may have a tow titer of between 60 and 160 ktex, preferably between 70 and 135 ktex. One distinct value of the tow titer of the first sub-tow may be 82 ktex. The second sub-tow may have a tow titer of more than 160 ktex, preferably more than 300 ktex. Of course, the sum of both sub-tow titers gives the full tow band titer.

A second preferred embodiment of the inventive method, the so-called "multiple-split" embodiment, comprises the following features:

m is greater than 1,
between step a. and step b. all primary sub tows are split into (n+1) secondary sub tows by n secondary guides and
the secondary sub-tows are plaited into containers.

Multiple tows to a tow titer required for processing on commercial stretch-breaking machinery can hereby be produced by sequentially introducing splits into the full tow with the finger guide device as aforementioned until the full tow is split (see FIG. 2) and equally subdivided into tows at the required tow titer. Thereby the invention significantly reduces the complexity for handling and collecting numerous tows and reduces the overall level of process equipment needed within the manufacturing environment.

Preferably in this embodiment of the invention the primary sub-tow is divided into 3 or more—preferably up to 6—secondary sub tows, preferably into 4 secondary sub tows.

Preferably all secondary sub tows originating from a primary sub tow are jointly plaited into one container. In a subsequent process step all secondary sub tows originating from one primary sub tow may be jointly pulled out of the container, separated and collected in individual containers. Containers could be cans or cartons or the like. These containers will then hold tow at a titer that meets the required processing constraints of commercial stretch-breaking machinery.

Preferably the primary sub tows have a tow titer of between 180 and 600 ktex.

Preferably the secondary sub tows have a tow titer of between 60 and 160 ktex, preferably between 70 and 135 ktex. One distinct value of the tow titer of the first sub-tow may be 82 ktex. In a further preferred embodiment of the invention all sub-tows show equal titers.

In one embodiment of the invention the means to transport the tow at the various stages uses conventional means including rollers and pulling devices.

A very specific aspect of the present invention is the splitting of a sub-tow according to the invention from a main tow: Once the fresh filaments have passed the coagulation zone, a predetermined number of spinneret filament bundles are gathered together within the extruded filament collection zone by the use of a novel lasso tie. The lasso tie is comprised of the same cellulose material namely lyocell and to the same specification as tow being manufactured at the time.

The filament titer making up these bundles can be in the range of 0.9 to 1.40 dtex and tow titer of each bundle can be in the range of 60 to 160 ktex.

The filament bundle with the lasso tie attached is allowed to pass through washing, treatment and drying zones of the process.

After exiting the drying zone the gathered filament bundle is identified, wherein a separating mechanism (see FIG. 3) is then introduced comprising of a finger guide device (see FIG. 4) to separate and split off the smaller tow bundle from larger tow. At this stage the lasso tie is cut out and removed. The lasso tie procedure is applicable to both the single-split and the multiple-split embodiments according to this invention.

Another object of the present invention consists in the use of the lyocell tow according to the invention as described above for the manufacture of blended yarns, wherein the lyocell tow is blended with one or more fiber types out of the group consisting of wool, other animal hairs like cashmere or mohair, silk, linen, acrylic, polyester, nylon and polypropylene. The term "wool" basically only means the hair of sheep. However other fiber types that are suitable and used for worsted spinning in general, may be used, as well. The suitable fiber types are further characterized by an appropriate fiber length, of normally above 60 mm and up to 150 mm and a fiber titer which is usually similar to the filament titer of the lyocell tow. Depending upon the type of product and end use those fiber titers may be higher or lower than the filament titer of the lyocell tow, however in most of those cases the filament titer of the lyocell tow will be finer than that of the other fiber.

The blending with other fibers is carried out at the gillbox stage after stretch breaking. Normally two, three or even four passages of gilling will be used. A stretch break convertor will normally carry out the stretch breaking of the lyocell tow into a lyocell top. Preferably this top will then be blended with other 100% lyocell tops at the gillbox to even out variations and maintain a consistent overall product. The stretch breaker (i.e. the tops manufacturer) will then package the tops after this first gilling stage into bump tops of approx. 10 Kg. These bump tops are then collected and packaged into bales of 400-500 Kg for sending on to worsted spinners. The worsted spinners then use the bump tops and blend at their first gillbox stage with wool, silk, linen, polyester, acrylic, nylon, etc. and do this for a further two or three passages. The blended tops are then processed into a roving using a rubbing frame or a roving frame and then spun on a worsted ringframe.

The process for blending using stretch broken or carded and combed worsted tops is essentially the same. The blending is by assembling tops of the different fibers on the creel of the gillbox, then combining and drafting the fibers from these tops into one blended top. Gillboxes can often have 20 or more inlets/feeds for tops on the creel, with only one outlet, so can allow for extensive blending. The more stages that are used for gilling the better the overall blending. Using stretch broken tops it is normally not necessary to use combing to remove the short filaments. However, using worsted carded tops it is normal to comb the tops to remove the short fibers and neps.

The yarns made according to the invention as described above are mainly used for the manufacture of circular- and flatbed knitted fabrics for sweaters, t-shirts, tops, woven shirts and blouses, ladies and men's outerwear for fine suits, dresses and skirts.

Yet another object of the present invention is a worsted yarn which contains or consists of lyocell fibers with a fiber titer of between 0.8 and 1.4 dtex and a mean fiber length of essentially more than 70 mm. Such yarns have never existed in Lyocell before the present invention was made. Up to now it was not possible to make yarns, in particular worsted yarns, with such fine, long staple lyocell fibers in a commercially accepted quality, i.e. with regard to uniformity, tenacity, thick and thin place imperfection levels and neps. The worsted spinning of fine dtex fiber in the range specified is only possible using the stretch break conversion technology, because long fibers in finer dtex were found to result in an inacceptable number of neps if processed by the worsted carding and combed process route. Main products are fine yarn count worsted blends of 50% by weight—crosslinked lyocell (for example LENZING™ Lyocell A100, available from Lenzing Aktiengesellschaft, Lenzing/Austria) with 50% by weight—merino wool or other animal hair like cashmere or mohair, though other blend combinations and blends with other fibers are also possible. The finer titer and higher tenacity in the cellulose component allows finer counts to be commercially spun for improved softness, drape and luster compared to previous products available.

The invention will now be illustrated by examples. These examples are not limiting the scope of the invention in any way. The invention includes also any other embodiments which are based on the same inventive concept.

EXAMPLES

Manufacture of the Samples

A lyocell tow band was produced according to a standard lyocell manufacturing process as described in e.g. U.S. Pat. No. 4,416,698 and EP 1307610 B2. Filament titer produced was according to the examples as follows.

The tow produced was stretch broken on various stretch breaking machines from the Seydel 682 through to the Seydel type 870 at machine speeds of 100-130 meters per minute. Overall drafts were in the range from 4.5-5.5, with only small drafts of 1.05-1.10 and 1.06-1.20 used for the first two stretching zones. Final zone ratch settings of between 150-170 mm for the first zone and 115-130 mm for the final zone were used. The drafts used and ratch zone settings influenced the results for the fiber length distribution as would normally be expected for any fiber after stretch breaking. The fiber length values were measured using Almeter and Wira test methods, also physical measurements of 50, 300 and 600 filaments. This also influenced the final result.

Lyocell tow has also been run on the NSC Seydel S200 machine at speeds of up to 225 meters per minute.

Example 1

The filament titer was 1.0 dtex, the tow band titer was 465 ktex. This tow band was split according to the single-split embodiment (FIG. 1) into a primary sub tow of 82 ktex and a residual tow of 383 ktex, using a device according to FIG. 3 and FIG. 4. The crimper was a regular mechanical gear crimper. While the residual tow was then cut to a staple length of 38 mm, the primary sub tow was plaited into a container and transferred to a tow to top convertor for stretch breaking trials. The tow was uniform and parallelized with less than 1 knot in the tow per container and with no twisting of the tow.

The resulting fibers showed a mean fiber length of between 55 and 105 mm with a CV % of 30-50%. The actual results vary according to the settings used for stretch breaking and fiber length testing method used, i.e. Almeter, Wira or physical measurements of fiber lengths of 50, 300 and 600 filaments. Generally fiber lengths of 40-165 mm were obtained with 15-40% of the fiber being <40 mm.

Example 2

The filament titer was 1.25 dtex; the tow band titer was 553 ktex. This tow band was split according to the single-split embodiment (FIG. 1) into a primary sub tow of 82 ktex and a residual tow of 471 ktex, using a device according to FIG. 3 and FIG. 4. The crimper was a regular mechanical gear crimper. While the residual tow was then cut to a staple length of 38 mm, the primary sub tow was plaited into a container and transferred to a tow to top convertor for stretch breaking trials. The tow was uniform and parallelized with less than 1 knot in the tow per container and with no twisting of the tow.

The resulting fibers showed a mean fiber length of between 60 and 115 mm with a CV % of 30-60%. The actual results vary according to the settings used for stretch breaking and fiber length testing method used, i.e. Almeter, Wira or physical measurements of fiber lengths of 50, 300 and 600 filaments. Generally, fiber lengths of 40-165 mm were obtained with 5-40% of the fiber being <40 mm.

Tops produced from stretch breaking have mostly been used in either 70%/30% (w/w) (lyocell/acrylic) blends or 50%/50% (w/w) blends with 1.7 dtex acrylic fibers or with Merino wool at around 16.5-17.5 Micron. Worsted spun yarns in counts up to 80 Nm have been produced. Yarn test results in terms of tenacity are higher than those for an equivalent 100% Merino wool, although yarn elongation is lower as would be expected. Commercially acceptable yarns have been produced for jersey knitting and for woven end uses, with this product being used for a variety of end uses such as woven shirts, woven suitings, sweaters, seamless running shirts, tee-shirts, tank tops and sportswear for running and hiking. Tops from 1.4 dtex lyocell have also been used for developments in carpets.

LEGEND

Figure 1:
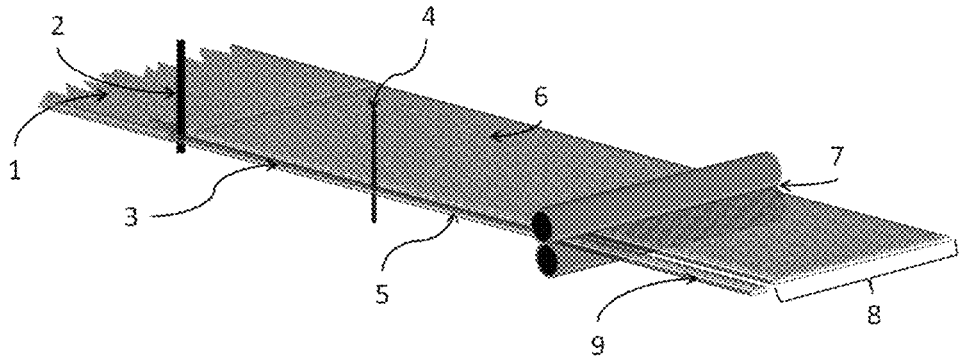
FIG. 1 shows the split-crimp-section of embodiment 1; m=1.
Figure 2:
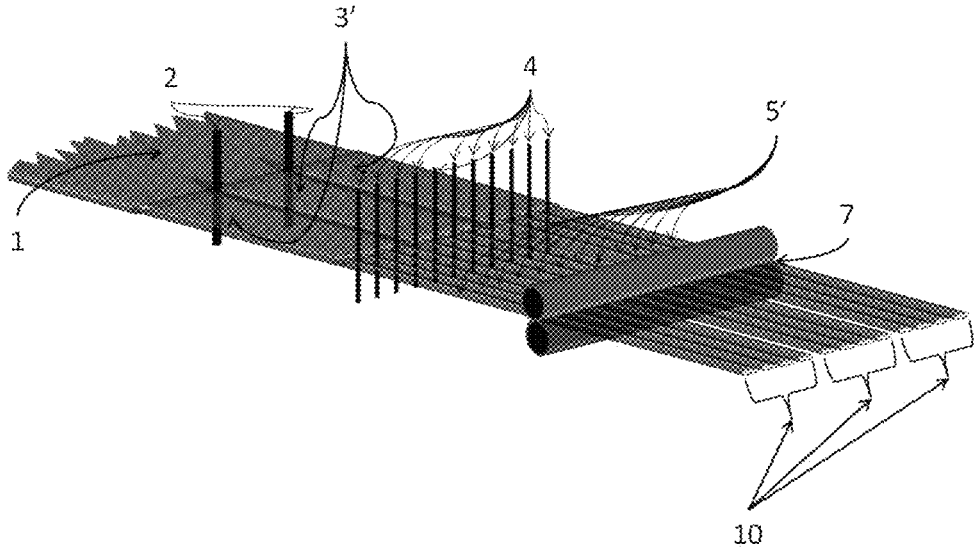
FIG. 2 shows the split-crimp-section of embodiment 2; the figure shows an embodiment with 2 primary guides and 11 secondary guides; m=2 and n=11.
Figure 3:
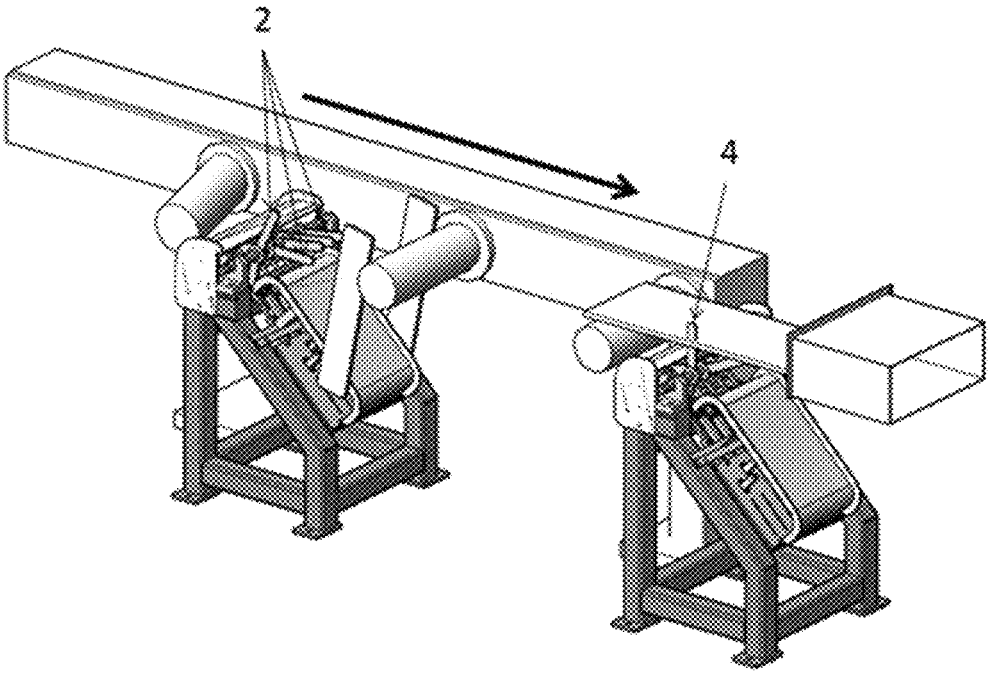
FIG. 3 shows a possible separating mechanism comprising of two finger guide devices to separate and split off the smaller tow bundle(s) from larger tow.
Figure 4:
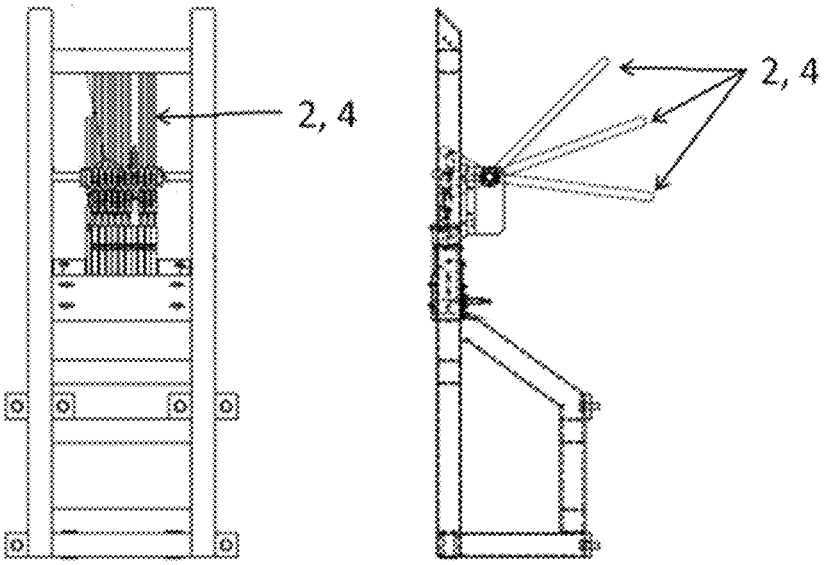
FIG. 4 shows a finger guide device as foreseen in FIG. 3; the guides can be individually moved into a splitting position. Left drawing: View into machine direction; right drawing: Side view.

1 Full tow band before splitting
2 Primary guide
3, 3' Primary sub tow
4 Secondary guide
5, 5' Secondary sub tow
6 Residual tow
7 Crimper
8 Residual, crimped tow
9 Crimped secondary sub tow of embodiment 1
10 Collection of crimped secondary sub tows of embodiment 2, originating from one primary sub tow

What is claimed is:

1. A method for the manufacture of a lyocell tow for use in stretch breaking or worsted or semi worsted spinning, comprising:

a. splitting a coagulated, washed, and dried lyocell full tow band into (m+1) primary sub tows by m primary guides;

b. jointly passing the primary sub tows through a crimper when the primary sub tows can be jointly crimped; and c. cutting at least m primary sub tows to lengths of between 1,000 and 10,000 m and subsequently plaiting into one or more containers, wherein m is greater than 1, wherein between step a. and step b., all primary sub tows are split into (n+1) secondary sub tows by n secondary guides, and wherein the secondary sub tows are plaited into containers, wherein n is greater than 2.

2. The method according to claim 1, wherein each individual filament is crimped and has a filament titer in the range of between 0.8 and 1.4 dtex, and wherein the lyocell tow has a tow titer of between 60 and 160 ktex and a length of between 1,000 and 10,000 m.

3. The method according to claim 2, wherein the lyocell tow comprises a finish suitable for stretch break and onward worsted and semi worsted processing.

4. The method according to claim 2, wherein fibers in the lyocell tow have a crosslinked surface.

5. The method according to claim 1, wherein each of the primary sub tows is divided into 3 or more secondary sub tows.

6. The method according to claim 1, wherein all secondary sub tows originating from one of the primary sub tows are jointly plaited into one container.

7. The method according to claim 6, wherein in a subsequent step, all secondary sub tows originating from one primary sub tow are jointly pulled out of the one container, and are separated and collected in individual containers.

8. The method according to claim 1, wherein the primary sub tows have a tow titer of between 180 and 600 ktex, and wherein the secondary sub tows have a tow titer of between 60 and 160 ktex.

9. A method for the manufacture of blended yarns using the lyocell tow produced by the method according to claim

1, comprising: blending the lyocell tow with one or more fiber types comprising wool, animal hairs other than wool, silk, linen, acrylic, polyester, nylon, or polypropylene.

10. A method for the manufacture of circular- and flatbed knitted fabrics for sweaters, t-shirts, tops, woven shirts and blouses, ladies and men's outerwear for fine suits, dresses, and skirts, using the blended yarns according to claim 9.

11. A method for the manufacture of a worsted yarn using the lyocell tow produced by the method according to claim 1, wherein the worsted yarn comprises a lyocell fiber having a fiber titer of between 0.8 and 1.4 dtex and a mean staple length of more than 70 mm.

12. The method according to claim 1, wherein each of the primary sub tows is divided into 3 or more and up to 6 secondary sub tows.

13. The method according to claim 1, wherein each of the primary sub tows is divided into 4 secondary sub tows.

* * * * *